US007673752B2

(12) United States Patent
Levy

(10) Patent No.: US 7,673,752 B2
(45) Date of Patent: Mar. 9, 2010

(54) DRUG CARD

(75) Inventor: Gordon Levy, Golden, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 619 days.

(21) Appl. No.: 11/518,896

(22) Filed: Sep. 12, 2006

(65) Prior Publication Data

US 2008/0060968 A1 Mar. 13, 2008

(51) Int. Cl.
*B65D 83/04* (2006.01)

(52) U.S. Cl. ..... 206/528; 206/534; 206/461; 206/470; 206/779

(58) Field of Classification Search ..... 206/528–532, 206/534, 495, 461–465, 467, 469–471, 775–783, 206/756, 767, 774
See application file for complete search history.

(56) References Cited

U.S. PATENT DOCUMENTS

| | | | | | |
|---|---|---|---|---|---|
| 2,834,456 | A | | 5/1958 | Langer | 206/532 |
| 3,835,995 | A | | 9/1974 | Haines | 206/42 |
| 3,899,080 | A | | 8/1975 | Brunda | 206/531 |
| 3,910,410 | A | * | 10/1975 | Shaw | 220/359.3 |
| RE29,705 | E | | 7/1978 | Compere | 206/531 |
| 4,200,193 | A | * | 4/1980 | Boyle | 206/461 |
| 4,506,789 | A | | 3/1985 | Dlugosz | 206/532 |
| 4,537,312 | A | | 8/1985 | Intini | 206/531 |
| 5,033,616 | A | * | 7/1991 | Wyser | 206/704 |
| 5,088,603 | A | * | 2/1992 | Kirkpatrick | 206/530 |
| 5,172,812 | A | | 12/1992 | Wharton | 206/531 |
| 5,310,060 | A | | 5/1994 | Bitner | 206/532 |
| 5,758,774 | A | | 6/1998 | Leblong | 206/531 |
| 5,785,180 | A | | 7/1998 | Dressel | 206/532 |
| 6,016,914 | A | * | 1/2000 | Gustafson | 206/470 |
| 6,161,699 | A | | 12/2000 | Gartland | 206/531 |
| 6,308,832 | B1 | * | 10/2001 | Pirro et al. | 206/469 |
| 6,974,032 | B2 | | 12/2005 | Intinind | 206/532 |
| 7,051,876 | B2 | * | 5/2006 | Grosskopf | 206/462 |
| 7,121,410 | B2 | * | 10/2006 | Rohrmus et al. | 206/531 |
| 7,506,761 | B2 | * | 3/2009 | Levy | 206/464 |
| 2003/0217949 | A1 | * | 11/2003 | Schamante | 206/705 |
| 2004/0159571 | A1 | * | 8/2004 | Fagen et al. | 206/461 |
| 2006/0016711 | A1 | * | 1/2006 | Ritter | 206/470 |
| 2006/0042986 | A1 | * | 3/2006 | Simkowski | 206/470 |
| 2006/0102512 | A1 | * | 5/2006 | Lo Duca | 206/531 |

* cited by examiner

*Primary Examiner*—Jacob K Ackun, Jr.
*Assistant Examiner*—Robert Poon
(74) *Attorney, Agent, or Firm*—Jacobson Holman PLLC

(57) ABSTRACT

A drug card having a tamper proof serrated pull tab on the back. The pull tab is partially removed from the back of the drug card to provide access to a plurality of individually sealed doses of medicine. A single dose of medicine is removed from the plurality of individually sealed doses of medicine, after which the remaining individually sealed doses of medicine are placed back in the card and the card resealed. The integrity of the drug card is thereby maintained while presenting a brand name of the product to the consumer at all times.

9 Claims, 5 Drawing Sheets

DRUG CARD

FIELD OF THE INVENTION

The present invention relates to a drug display card containing a plurality of interconnected individual doses of medicine.

BACKGROUND OF THE INVENTION

In drug stores, convenience stores, grocery stores or other retailers, selling small quantities of nonprescription drugs, a display device is used to sell small quantities of a pain reliever, for example. Usually, if more than one dose of a medicine is being sold by the display device, a single dose at a time of medicine is dispensed from the card. The dispensing is done by a permanent deformation of the display device which cannot be resealed.

It has not previously been possible to open a tamper resistant package to access more than one dose of individually sealed medication by removing all the doses of medication from the display device and returning a portion of the doses or unused doses back to the display device. After the returning of the unused doses, it would be desirable to again have a sealed display device.

Accordingly, there is a need for accessing more than one dose of medication at a time from a display device and returning the unused individually sealed doses back into the display device for subsequent retrieval.

SUMMARY OF THE INVENTION

It is therefore an object of the present invention to remove a plurality of individually sealed doses of medication from a tamper resistant package, separate one of the doses of medication from the plurality of doses of medication and return the unused individually sealed doses back into the drug card, which is then resealed.

This object is obtained by the use of a drug card having a tamper proof serrated pull tab on the back. The pull tab is partially removed from the back of the drug card to provide access to a plurality of individually sealed doses of medicine. A single dose of medicine is removed from the plurality of individually sealed doses of medicine, after which the remaining individually sealed doses of medicine are placed back in the card and the card resealed. The integrity of the drug card is thereby maintained while presenting a brand name of the product to the consumer at all times while maintaining all drug facts intact.

It is another object of the present invention to provide a drug card having a front display of a plurality of individual doses of medicine and providing a tamper proof serrated pull tab on the back of the drug card for removal of a plurality of interconnected, individual doses of a medicine.

It is another object of the present invention to provide a drug card having a front display of a plurality of individual doses of medicine and providing a tamper proof serrated pull tab on the back of the drug card for removal of a plurality of interconnected, individual doses of a medicine with a single dose of medicine being separated from the plurality of doses of medicine and the remaining doses of medicine being returned to the card and the pull tab on the back of the card being resealed.

It is still yet another object of the present invention to provide a drug card having a front display of a plurality of individual doses of medicine and providing a tamper proof serrated pull tab on the back of the drug card for removal of a plurality of interconnected, individual doses of a medicine with a single dose of medicine being separated from the plurality of doses of medicine and the remaining doses of medicine being returned to the card and the pull tab on the back of the card being resealed with the plurality of individual doses of medicine being interconnected and separable by perforations for removal of the one dose of medicine while maintaining the remaining doses of medicine an integral unit returnable to the drug card.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the Drug Card disclosed herein, and are for illustrative purposes only. Other embodiments that are substantially similar can use other components that have a different appearance.

DETAILED DESCRIPTION OF THE PREFERRED EMBODIMENTS

Figure 1:
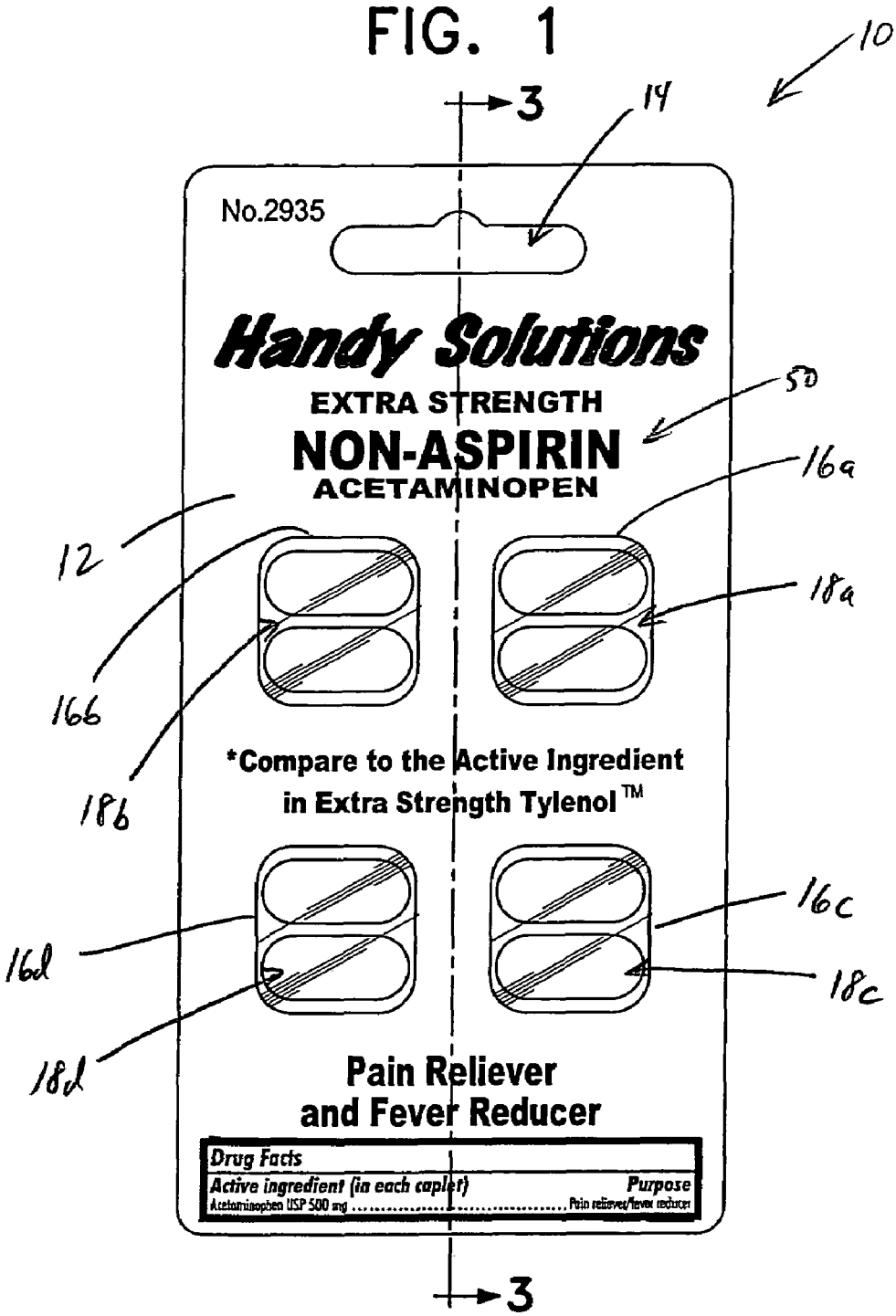
FIG. 1 is a front view of the present invention illustrating a plurality of individual doses of medicine protruding through the front surface of a drug card.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
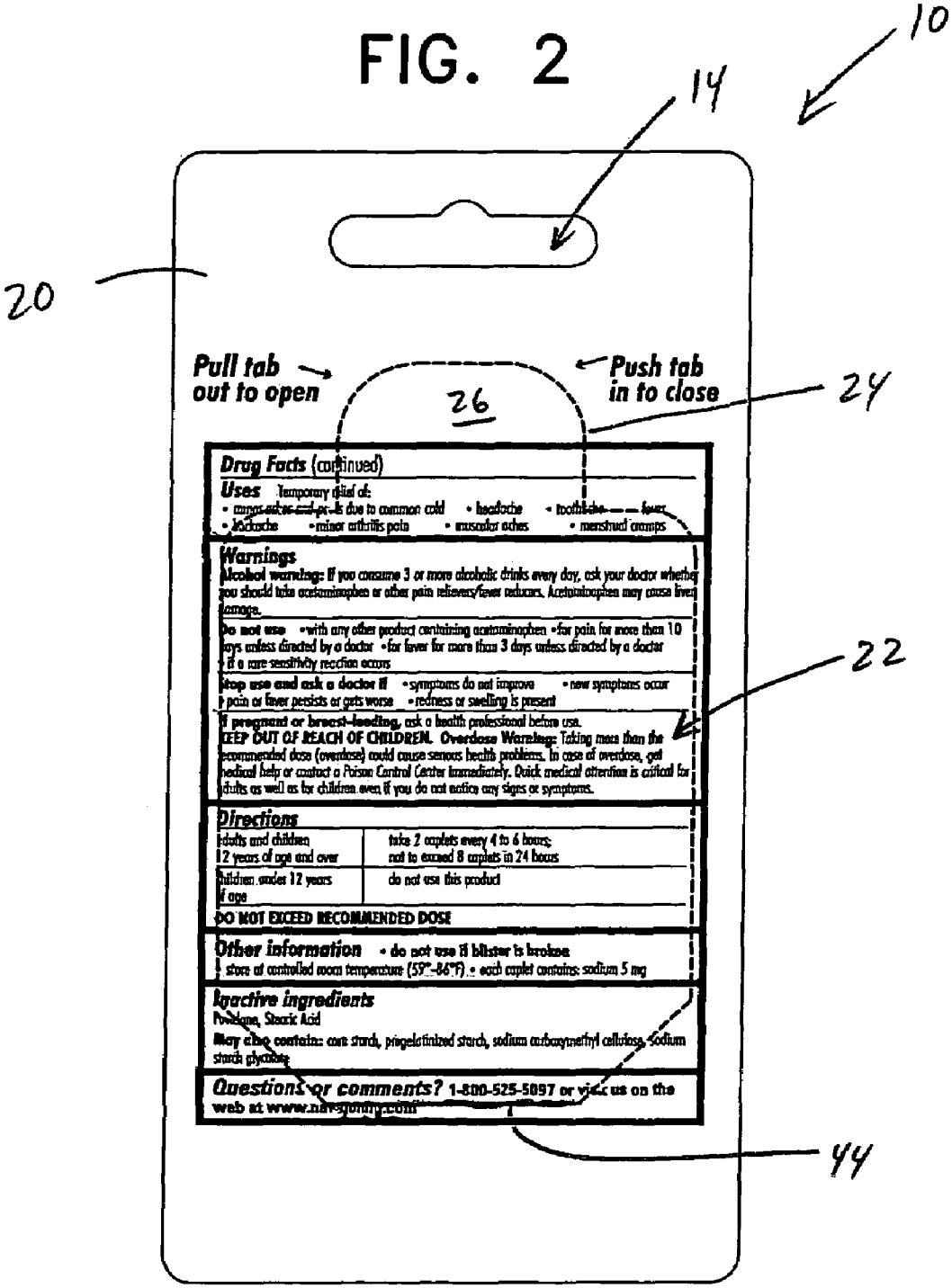
FIG. 2 is a rear view of the drug card illustrating the serrated pull tab separable from the back of the card so as to gain access to the plurality of interconnected individual doses of medicine.
Figure 3:
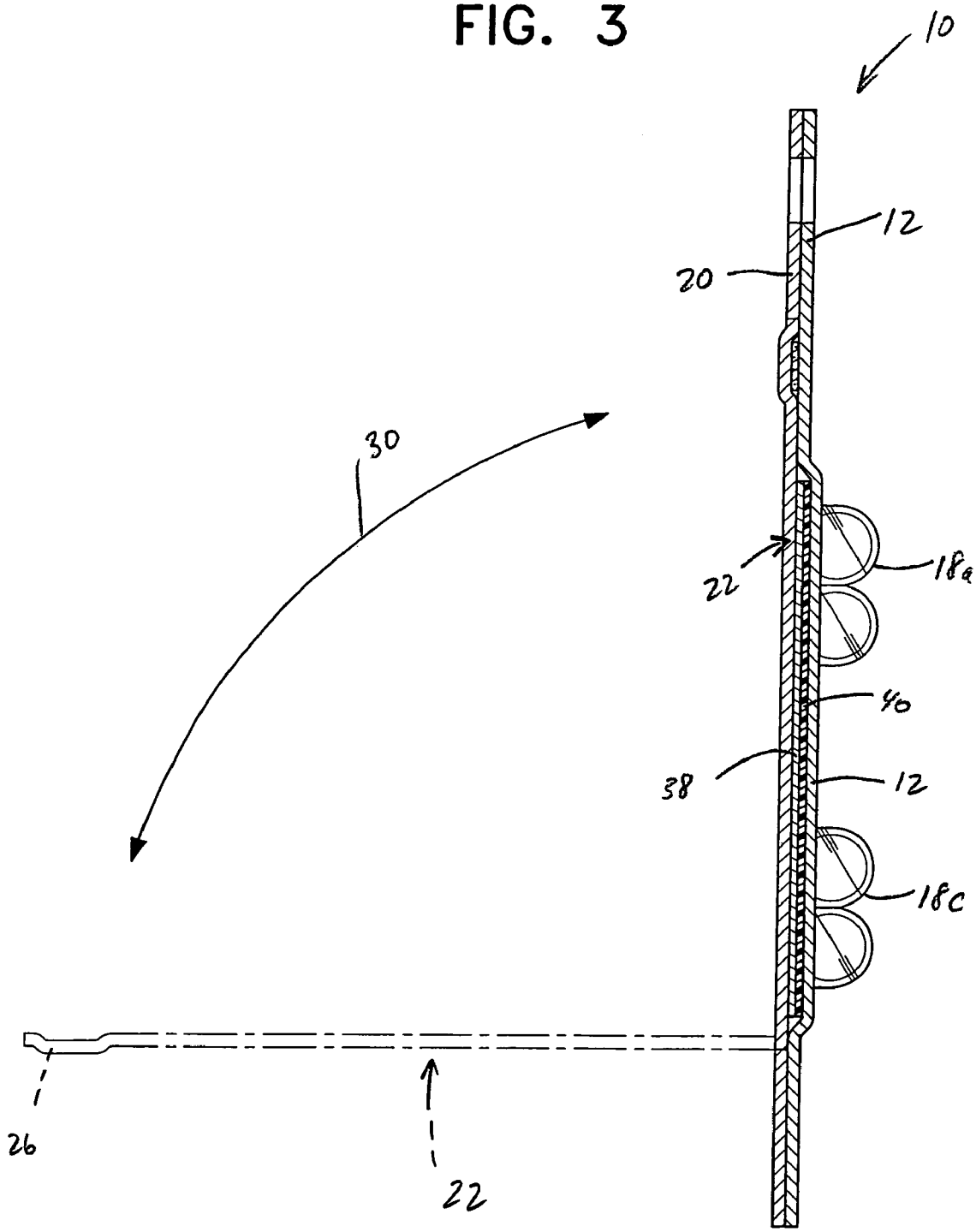
FIG. 3 is a sectional line taken along line 3-3 of FIG. 1.

With reference to the drawings in general, and to FIGS. 1 through 3, in particular, a drug card embodying the teachings of the subject invention is generally designated as 10. With reference to its orientation in FIG. 1, the drug card 10 includes a front surface 12 having a hang opening 14. The front surface 12 also includes, in this example, four openings 16*a*, 16*b*, 16*c* and 16*d* through which individual doses 18*a*, 18*b*, 18*c* and 18*d* of medicine protrude. Each dose in this example includes two tablets.

As shown in FIG. 2, the rear surface 20 of the drug card 10 includes a pull tab 22 defined by a continuous perforation line 24. The pull tab 22 is anchored to the rear surface by fold line 44.

The upper tab 26 of the pull tab is initially separated from the rear surface 20 of the drug card 10. Continued pulling of tub 26 separates tab 22 from the rear surface 20 until reaching fold line 44. Access to the doses of medicine is thereby achieved.

As shown in FIG. 3, the front surface 12 and the rear surface 20 are formed of two separate layers of cardboard which are secured together. In FIG. 3, the pull tab 22 is moved from the position, shown in solid lines, overlying the interconnected individual doses of medicine, in the direction of arrow 30 to the position shown in dotted lines so as to gain access to the rear of the drug card 10 and to the plurality of interconnected individual doses of medicine.

Figure 4:
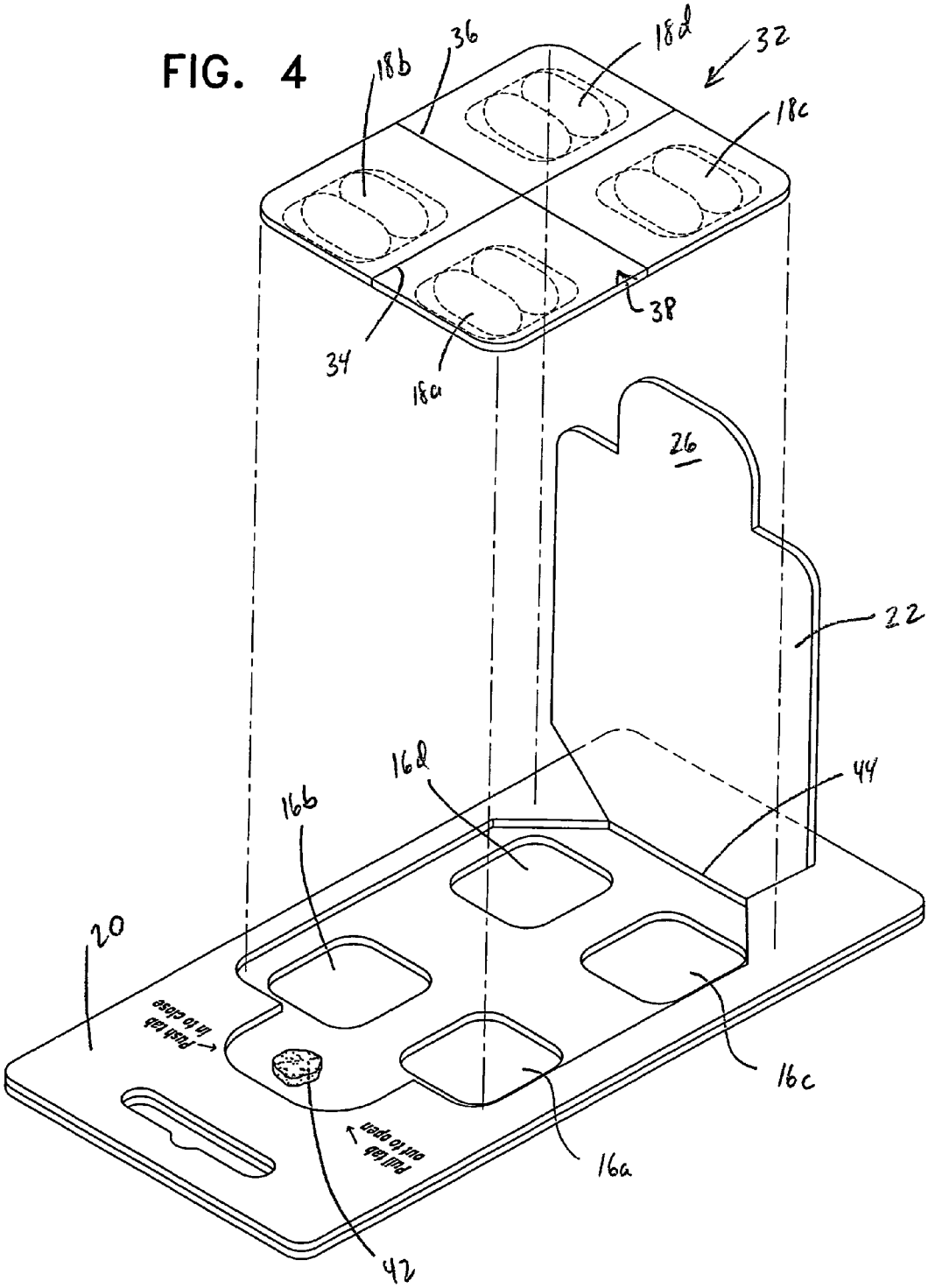
FIG. 4 illustrates the partial removal of the pull tab from the rear surface of the drug card and removal of a plurality of interconnected individual doses of medicine as an integral unit.

As shown in FIG. 4, the four individual doses of medicine 18*a*, 18*b*, 18*c* and 18*d* are interconnected to form a single integrated unit 32 of four individual doses of medicine. The doses of medicine are connected by longitudinal perforation line 34 and lateral perforation line 36 so as to be able to easily separate the four individual doses of medicine.

As shown in FIG. 3, the individual doses of medicine, each consisting of two tablets, are sealed by a rear layer of removable metallic foil 38 overlying a layer of plastic 40 having projecting blisters containing the two tablets. The two tablets project vertically from front surface 12 of the drug card 10.

As shown in FIG. 4, the interconnected unit 32 of a plurality of doses of medicine has been removed from the drug card by the pulling of the tab 26 of the pull tab 22 so as to separate the pull tab from the rear surface 20 of the drug card. A glob of adhesive glue 42 helps secure the pull tab 22 in place, aligned with the rear surface 20 of the drug card 10. The separation along the serrated perforation line 24 allows partial removal of the pull tab 22 from the rear surface 20 so as to bend the pull tab along fold line 44. The pull tab 22 remains connected to the rear surface 20 of the drug card 10.

Figure 5:
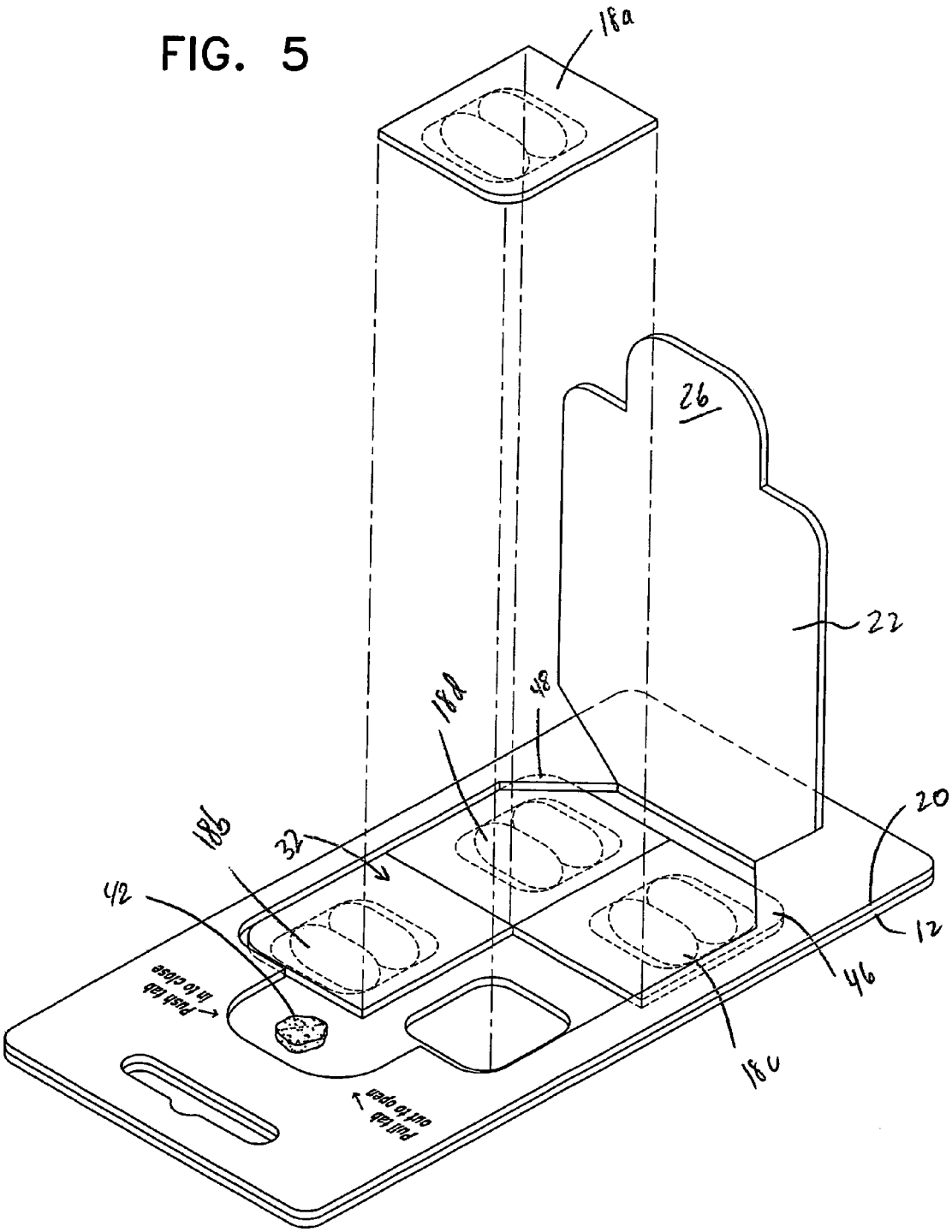
FIG. 5 illustrates the separation of one of the doses of medicine from the plurality of interconnected doses of medicine and the return of the remaining doses of medicine into the drug card for display through the front of the card and the resealing of the pull tab on the back of the card.

As shown in FIG. 5, a single dose of medicine 18a is removed from the plurality of interconnected doses of medicine forming the integral unit 32. In this example, the three remaining interconnected individual doses of medicine are returned to the display device so that the doses of medicine project through the openings 16*b*, 16*c*, 16*d* in the front surface 12 of the drug card 10. It is noted that the corners 46, 48 of the doses of medicine 18*c*, 18*d* are forced to friction fit between the front surface 12 and the rear surface 20 of the drug card to assist in securing their position in the drug card.

Thereafter, the pull tab 22 is moved to lie in the plane of the rear surface 20 so that the pull tab 26 overlies and is pressed into engagement with the adhesive 42. The adhesive secures the pull tab in the plane of the rear surface 20. The front surface 12 of the drug card would now have three individual doses, in this example, of medicine exposed through the front surface 12 of the drug card 10.

The medicine product is thereby continued to be displayed through the front surface 12 of the drug card even though one dose of medicine 18*a* has been removed from the plurality of interconnected doses of medicine. Further, the identifiers 50 of the front surface 12 of the drug card 10 lying in between and around the individual doses of medicine would advise the purchaser of the contents of the drug card 10, even though a portion of the originally supplied medicine had been removed.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A drug display card for displaying individual doses of medicine, said drug display card comprising a front surface, a rear surface including a panel, said panel being pivotally mounted on said rear surface, a plurality of interconnected individual doses of medicine located between the front surface and the rear surface, said panel overlying said plurality of interconnected individual doses of medicine, and a pull tab of the panel, said pull tab being removably secured to the front surface for gaining access to the plurality of interconnected individual doses of medicine and for resealing the plurality of interconnected individual doses of medicine between the front surface and the rear surface, the pull tab forming a part of the panel and extending in a plane of the rear surface when resealed, the front surface including a plurality of openings for receipt of individual doses of said plurality of interconnected individual doses of medicine.

2. The drug display card as claimed in claim 1, wherein the individual doses extend through the plurality of openings.

3. The drug display card as claimed in claim 2, wherein the pull tab is removably secured to the front surface by adhesive.

4. The drug display card as claimed in claim 1, wherein the panel is defined by perforations in the rear surface.

5. The drug display card as claimed in claim 4, wherein the panel includes a fold line in the rear surface.

6. The drug display card as claimed in claim 1, wherein the plurality of interconnected individual doses of medicine are interconnected by at least one line of perforations.

7. The drug display card as claimed in claim 1, wherein at least one corner of the plurality of interconnected individual doses of medicine is wedged between the front surface and the rear surface.

8. A drug display card for displaying individual doses of medicine, said drug display card comprising a front surface, a rear surface including a panel, said panel being pivotally mounted on said rear surface, a plurality of interconnected individual doses of medicine located between the front surface and the rear surface, said panel overlying said plurality of interconnected individual doses of medicine, and a pull tab of the panel, said pull tab being removably secured to the front surface for gaining access to the plurality of interconnected individual doses of medicine and for resealing the plurality of interconnected individual doses of medicine between the front surface and the rear surface, the pull tab forming a part of the panel and extending in a plane of the rear surface when resealed, a plastic blister of the plurality of interconnected individual doses of medicine projecting through the front surface.

9. The drug display card as claimed in claim 1, wherein portions of the front surface extend between and around the plurality of openings.

* * * * *